US005634732A

United States Patent [19]

Ushirooka et al.

[11] Patent Number: 5,634,732

[45] Date of Patent: Jun. 3, 1997

[54] BINDING ASSEMBLY FOR BINDERS

[75] Inventors: Kenji Ushirooka, Tokyo; Tatsuya Fujiwara; Hajime Taima, both of Kanagawa-ken, all of Japan

[73] Assignees: Lion Office Products Corporation, Osaka; NIFCO Inc., Kanagawa-ken, both of Japan

[21] Appl. No.: 524,459

[22] Filed: Sep. 7, 1995

[30] Foreign Application Priority Data

Sep. 7, 1994 [JP] Japan ..... 6-239482

[51] Int. Cl.[6] ..... B42F 13/34

[52] U.S. Cl. ..... 402/46; 402/48; 281/21.1

[58] Field of Search ..... 402/46–52, 55, 402/56, 25, 35; 281/21.1, 36

[56] References Cited

U.S. PATENT DOCUMENTS

| | | | |
|---|---|---|---|
| 4,060,330 | 11/1977 | Baccile | 402/48 X |
| 4,222,679 | 9/1980 | Luogameno | 402/75 |
| 4,693,625 | 9/1987 | Ohminato | 402/48 |
| 4,730,950 | 3/1988 | Ominato | 402/48 |
| 4,984,925 | 1/1991 | Chen | 402/8 |
| 5,330,280 | 7/1994 | Kaneda et al. | 402/49 |

FOREIGN PATENT DOCUMENTS

| | | | |
|---|---|---|---|
| 2107125 | 8/1978 | Germany | 402/48 |
| 52-52660 | 11/1977 | Japan . | |
| 2-64081 | 5/1990 | Japan . | |
| 2-32466 | 9/1990 | Japan . | |
| 3-4551 | 2/1991 | Japan . | |
| 3-87286 | 9/1991 | Japan . | |
| 4-341898 | 11/1992 | Japan . | |
| 2229398 | 9/1990 | United Kingdom | 402/48 |

*Primary Examiner*—Frances Han

[57] ABSTRACT

In a binding assembly for binders for holding a number of sheets of paper detachably bound together, the clamping unit, which includes a pair of metallic clamping plates for holding the paper therebetween, is detachably latched to a holder base which is in turn permanently attached to the binding of a binder. The clamping unit is provided with a bar extending across a cutout provided in a lower edge of each clamping plate, and the bar latches onto a latching mechanism provided in the holder base. Either one of the clamping plates may be selectively latched onto or unlatched away from the holder base while the other clamping plate is kept hinged to the holder base. The latching mechanism includes a pair of latch members made of plastic material, and slidably retained by a metallic base plate of the holder base, and the load applied to the clamping unit is primarily supported by the metallic base plate for minimizing the load applied to the latch members. The load which tends to pull the clamping unit away from the holder base is supported by holding pieces which are lifted from the base plate, and bent over the latch members. The binding assembly is thus made highly simple in structure, and economical and easy to manufacture. By making the essential parts of the latching mechanism with plastic material, it is possible to ensure the accurate and reliable action of the latching mechanism.

13 Claims, 6 Drawing Sheets

BINDING ASSEMBLY FOR BINDERS

TECHNICAL FIELD

The present invention relates to a binding assembly for binders which binds sheets of paper, and in particular to a binding assembly which allows one to file and remove paper sheets from either end, i.e., first-in first-out or last-in first-out.

BACKGROUND OF THE INVENTION

Various binders have been proposed using different binding assemblies. Typically, a plurality of holes are punched along an edge of each sheet of paper so that metallic rods or pipes are passed through these holes for retaining the paper sheets in the binding assembly. Thus, a binding assembly typically comprises a holder base which is normally attached to the inner surface of the binding of the binder, and a pair of clamping plates attached to the holder base for holding the paper sheets from both sides. A plurality of pipes project from one of the clamping plates toward the other clamping plate, and the associated rods, projecting from the other clamping plate, are received in the pipes. Conventionally, one of the clamping plates is hinged to the holder base while the other clamping plate is detachably latched to the holder base so that sheets of paper can be added to or removed from the binder at will.

The binding assembly has been conventionally composed of stamped sheet metal, but it is more preferable to fabricate a major part of the binding assembly from plastic material for the simplification of the assembling process and for the reduction of the manufacturing cost. However, using a latching mechanism made of plastic material has never been commercially successful because plastic latching mechanisms, when used in conventional binding assemblies, are unable to withstand severe impacts that latching mechanisms are subjected to.

More recently, it has been proposed to make both clamping plates detachable so that either one of them may be selectively removed while the other one is kept hinged to the holder base. Thereby, one is allowed to file and remove paper sheets from either end, i.e., first-in first-out or last-in first-out, without being required to unnecessarily remove and replace sheets of paper.

According to such a recently proposed binding assembly, a spring-loaded latching mechanism is needed for each clamping plate, and although it is possible to latch each clamping plate onto the holder base with a single hand, it is necessary to use both hands simultaneously when unlatching the clamping plate from the holder base, one hand for unlatching the latching mechanism and the other for pulling the clamping plate away from the holder base. To avoid this inconvenience, it is possible to use a heart cam mechanism so that the latching mechanism can be latched and unlatched in an alternating fashion each time the user pushes a lever, but it complicates the latching mechanism and adds to the manufacturing cost.

BRIEF SUMMARY OF THE INVENTION

In view of such problems of the prior art, a primary object of the present invention is to provide a binding assembly for binders which uses plastic material for a major part of its latching mechanism, and can still ensure a sufficient durability in use.

A second object of the present invention is to provide a binding assembly for binders which is economical and easy to manufacture.

A third object of the present invention is to provide a binding assembly for binders which is convenient to use by allowing access from either side.

According to the present invention, these and other objects can be accomplished by providing a binding assembly for binders, comprising: a clamping unit including a pair of clamping plates having paper holding means for holding a plurality of sheets of paper therebetween, each clamping plate being provided with a cutout on lower edge thereof, and a bar extending across the cutout; a holder base including a base plate which is made of a metallic member and adapted to be attached to a binding of a binder; a cover adapted to be fitted over the base plate; and a pair of latch members made of plastic material and received between the base plate and the cover; a latch mechanism being formed between each of the latch members and an associated tab lifted from the base plate for detachably engaging the bar; wherein: the metallic base plate is provided with first stopper means for supporting a lower edge of each of the clamping plates, second stopper means for engaging a side edge of a cutout formed in the lower edge of each of the clamping plates, and third stopper means for securing each of the latch members from being pulled away from the base plate.

Thus, the load applied to the holder base via the clamping unit can be supported primarily by the base plate, and the latch members are not placed under any severe load so that the latch members can be made of plastic material without compromising the durability of the binding assembly. By making the latch members from plastic material, it is possible to reduce the manufacturing cost, and to increase the freedom in designing the latching mechanism.

According to a preferred embodiment of the present invention, the first stopper means comprises an upper surface of a base end of each of the tabs abutting lower edge portions of an associated one of the clamping plates which are crimped over end portions of the bar, and the second stopper means comprises side edges of a base end of each of the tabs, the side edges engaging associated side edges of the cutout across which the bar extends.

According to the preferred embodiment of the present invention, the third stopper means comprises a holding piece which is lifted from the base plate, and bent laterally at a free end portion thereof for retaining the latch member between the free end portion and the base plate, and an opening which is provided in an upright part of the holding piece for receiving a complementary projection formed in the latch member. Therefore, even though the pulling load applied to the holder base must be supported by the latch members, this structure for the third stopper means allows the pulling load to be supported by the latch members in a favorable manner.

Because the latch members may be made of plastic material, each of the latch members may be provided with a knob extending out of a side wall of the cover, spring means urging the latch member outwardly, and an upper jaw which defines a gap in cooperation with the tab for receiving the bar when the latch member is inwardly pressed by the knob against a spring force of the spring means, the gap being dosed when the latch member is restored to an initial position thereof under the spring force of the spring means. Typically, the spring means consists of a pair of spring pieces extending obliquely and inwardly from the latch member, free ends of the spring pieces abutting a longitudinal wall depending from an inner surface of the cover. Also, to allow the clamping unit to be readily attached to the holder base simply by pushing the bar onto the latching mechanism, the upper surface of the upper jaw may be provided with a tapered surface for allowing the upper jaw to be moved away from the associated tab to open the gap when the bar is pressed onto the tapered surface.

To ensure a smooth movement of each of the latch members, the latch member and the cover may be engaged by a first lateral guide mechanism including a lateral groove and a ridge received in the groove, and a second lateral guide mechanism including a projection and an associated slot having a lateral open end for receiving the projection.

To allow the latching mechanism to be unlatched and the clamping unit pulled away from the holder base with a single hand, each of the latch members may be provided with a claw on an upper end thereof which is adapted to be engaged by a corresponding claw provided in an inner surface of the cover so as to keep the gap between the upper jaw and the tab open. A tilting means for tilting the latch member is provided to engage the claw thereof with the corresponding claw when the latch member is inwardly depressed by pressing the knob inwards, and a lower jaw is provided under the upper jaw for disengaging the claw of the latch member from the corresponding claw by being pressed downward by the bar.

The tilting means may comprise a slanted abutting surface defined between the free ends of the spring pieces and the longitudinal wall, and/or a spring piece interposed between a relatively external part of a lower surface of each of the latch members and the base plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
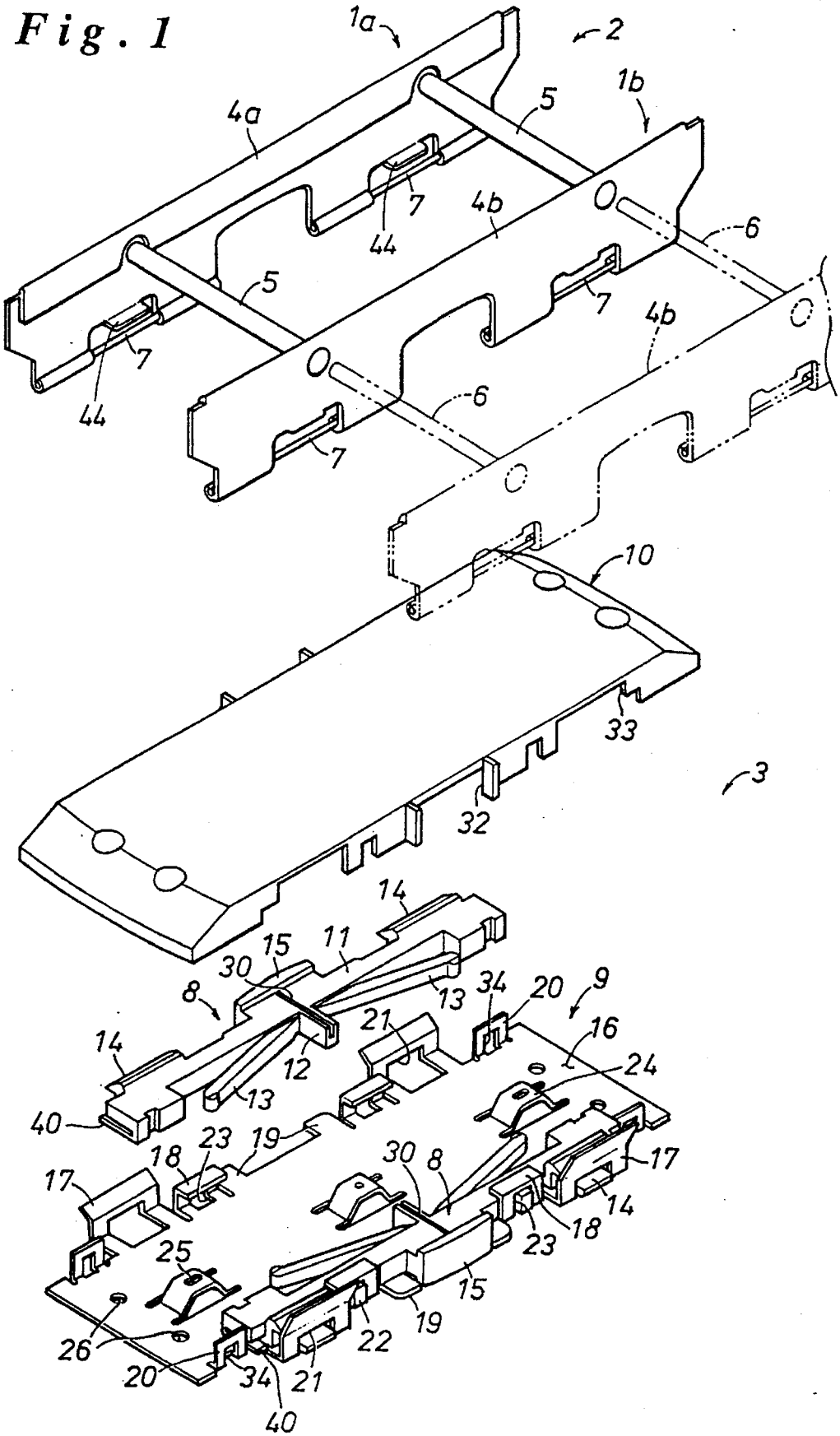
FIG. 1 is an exploded perspective view of the general structure of the preferred embodiment of the present invention.

FIG. 1 generally shows a preferred embodiment of the binding assembly according to the present invention. This binding device comprises a clamping unit 2 consisting of two halves 1*a* and 1*b*, each mainly consisting of a clamping plate 4*a* or 4*b*, for holding sheets of paper (not shown in the drawing) from both sides, and a holder base 3 which detachably engages the clamping unit 2, and which is adapted to be mounted on the inner surface of the binding of a binder.

One of the clamping plates 4*a* is provided with a pair of pipes 5 extending perpendicularly therefrom toward the other clamping plate 4*b*, and a pair of rods 6 which similarly extend from the other clamping plate 4*b* and are received in the corresponding pipes 5. Each paper sheet (not shown in the drawing) is provided with a pair of holes along one edge thereof, and a large number of sheets of paper can be retained in the binder by passing the pipes 5 through these holes. The clamping plates 4*a* and 4*b* are made of stamped sheet metal, and are each provided with three cutouts along the lower edge thereof. A metallic bar 7 extends along the open end of each of the two cutouts provided near the longitudinal ends of each of the clamping plates, and is secured thereto at two ends thereby by being crimped by tabs cut out from the material of the clamping plate. These metallic bars 7 serve both as a hinge and a latch striker as described in more detail hereinafter. A tab 44 is bent inward from upper edge of each of the cutouts across which the bars 7 extend, and defines the limit for the inner edges of the sheets of paper held between the clamping plates 4*a* and 4*b* so that the sheets of paper may not interfere with the action of the latching mechanism which is described hereinafter.

The holder base 3 comprises a pair of latch members 8 made of suitable plastic material, a metallic base plate 9 adapted to be mounted on the inner surface of the binding of a binder, and a cover 10 which fits onto the base plate 9 with the latch members 8 enclosed therebetween.

Each of the latch members 8 comprises an elongated main body 11 having a substantially rectangular cross section, a guide projection 12 projecting inwards from a central part of the main body 11, a pair of spring pieces 13 extending obliquely from a base end of the guide projection away from each other in a symmetric fashion, a pair of latch/hinge sections 14 each provided on the outer surface of the main body 11 near longitudinal ends thereof, and a knob 15 provided between the latch/hinge sections 14 on the outer surface of the main body 11. Each of the latch/hinge sections 14 includes an upper jaw 14*a* which extends laterally from the main body 11, and a lower jaw 14*b* which extends in parallel with the upper jaw 14*a*, and is somewhat longer than the upper jaw 14*a*. The latch members 8 can be manufactured, for instance, by injection molding.

The base plate 9 is made by stamp formed metallic plate, and comprises a substantially rectangular main body 16, two pairs of latch/hinge tabs 17 lifted from the corresponding side edges of the main body 16, two pairs of holding pieces 18 lifted from the corresponding side edges of the main body 16 and inwardly bent over the main body 16 into the shape of the letter-C of a rectangular representation, two pairs of horizontal tabs 19 extending laterally from the corresponding side edges of the main body 16, and two pairs of vertical tabs 20 lifted from the corresponding side edges of the main body 16.

Each of the latch/hinge tabs 17 is lifted from the corresponding side edge of the main body 16 substantially at a right angle, and is slightly slanted outward at its upper end. An opening 21 is provided in each of the latch/hinge tabs 17 for receiving the lower jaw 14*b* of the corresponding latch/hinge section 14 of the latch member 8. As illustrated in FIG.

3, the corresponding metallic bar 7 is normally received in the space defined by the upper and lower jaws 14*a* and 14*b* of the corresponding latch/hinge section 14, and the corresponding latch/hinge tab 17. The holding pieces 18 are bent inwardly at an intermediate part thereof, and snugly hold the latch members 8 in cooperation with the main body 16 of the base plate 9. Each of the holding pieces 18 is provided with a rectangular opening 23 for receiving a complementary projection 22 provided in the corresponding latch member 8.

Figure 2:
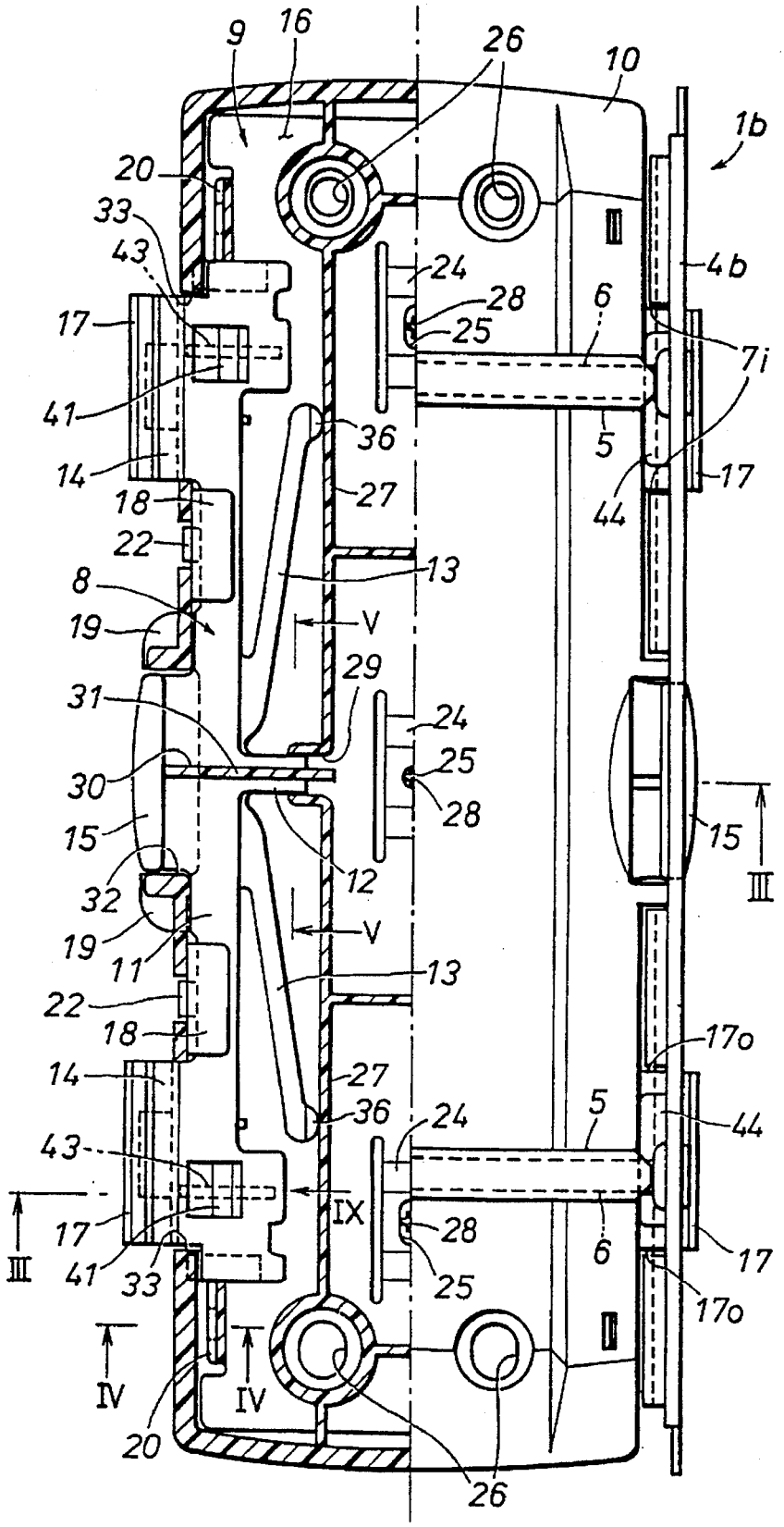
FIG. 2 is a plan view generally showing the binding assembly partly in section.

Three projections 24, each having a trapezoidal shape as seen from a side, are lifted from the material of the main body 16 of the base plate 9, and arranged in a single row along a longitudinal central line thereof. Each of the trapezoidal projections 24 is provided with an opening 25. As illustrated in FIGS. 1 and 2, the opening 25 of the central trapezoidal projection 24 is circular while the openings 25 of the trapezoidal projections 24 on either longitudinal end are longitudinally elongated. The main body 16 of the base plate 9 is provided with four mounting holes 26, and is adapted to be attached to the binding of a binder by rivets passed through these mounting holes 26.

Figure 4:
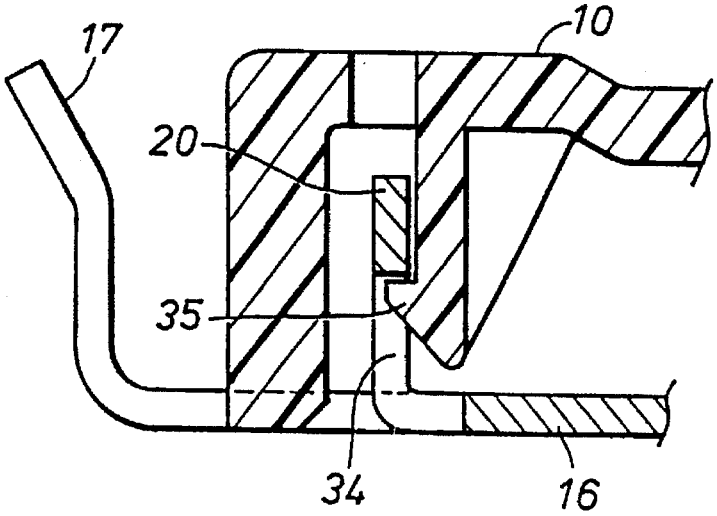
FIG. 4 is an enlarged fragmentary sectional view taken along line IV—IV of FIG. 2.

The cover 10 consists of an essentially box-shaped plastic member which is made by injection molding. The cover 10 can be attached to the base plate 9, with the latch members 8 interposed therebetween, by virtue of four barbed projections 35 which are provided in the inner surface of the cover 10 and which are snap fitted into openings 34 of the vertical tabs 20 of the base plate 9 as best illustrated in FIG. 4. The inner surface of the cover 10 is further provided with a pair of longitudinal walls 27 to which the free ends of the spring pieces 13 abut, three pins 28 adapted to fit into the openings 25 of the trapezoidal projections 24 of the base plate 9, a pair of guide slots 29 provided in the longitudinal walls 27 for receiving the guide projections 12 of the latch members 8, and a pair of projections 31 adapted to be received by grooves 30 provided in the upper surfaces of the guide projections 12. The lateral side walls of the cover 10 are each provided with a central cutout 32, and a pair of slightly smaller cutouts 33 located on either side of the central cutout 32 for exposing the knob 15 and the latch/hinge sections 14 of the corresponding latch member 8, respectively.

When assembling the holder base 3, first of all, the latch members 8 are pushed under the inwardly bent upper ends of the holding pieces 18. Because the knobs 15 are each slightly offset both from a longitudinal center and from the major surface of the base plate 9, the latch members 8 are prevented from being installed in an inverted orientation.

Figure 5:
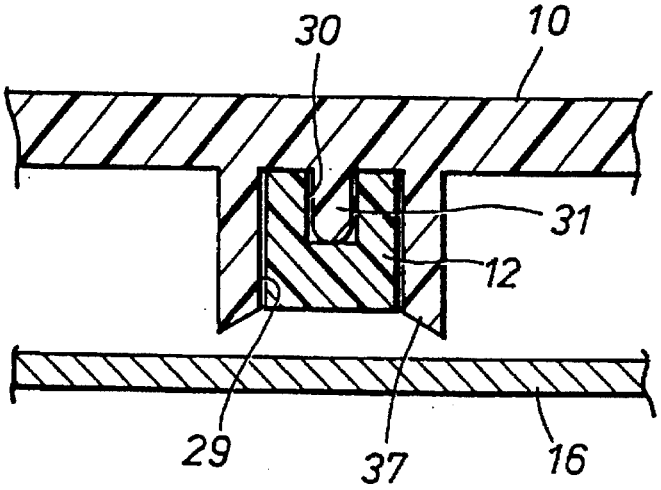
FIG. 5 is an enlarged fragmentary sectional view taken along line V—V of FIG. 2.

Then, the cover 10 is placed onto the base plate 9 with the pins 28 of the cover 10 guided by and fitted into the openings 25 of the trapezoidal projections 24. Thus, this assembling step can be carded out in proper alignment Without any difficulty. As the cover 10 is pushed against the base plate 9, the barbed projections 35 of the cover 10 are fitted into the openings 34 of the vertical tabs 20, and the cover 10 is positively secured against the force lifting it away from the base plate 9 (see FIG. 4). Because a tapered surface 36 is provided in the upper comer of the free end of each of the spring pieces 13 of the latch members 8, the longitudinal walls 27 would not be interfered with by the spring pieces 13 when the cover 10 is placed over the base plate 9. The open end of each guide slot 29 is also provided with tapered surfaces 37, as best illustrated in FIG. 5, so that the guide projection 12 can be smoothly fitted into the guide slot 29 when placing the cover 10 over the base plate 9. Thus, the latch members 8 can be properly positioned between the base plate 9 and the cover 10 with very little effort.

Finally, the binding assembly is securely attached to the binding of a binder by rivets (not shown in the drawings) passed through the mounting holes of the cover 10 and the mounting holes 26 of the base plate 9.

Figure 3:
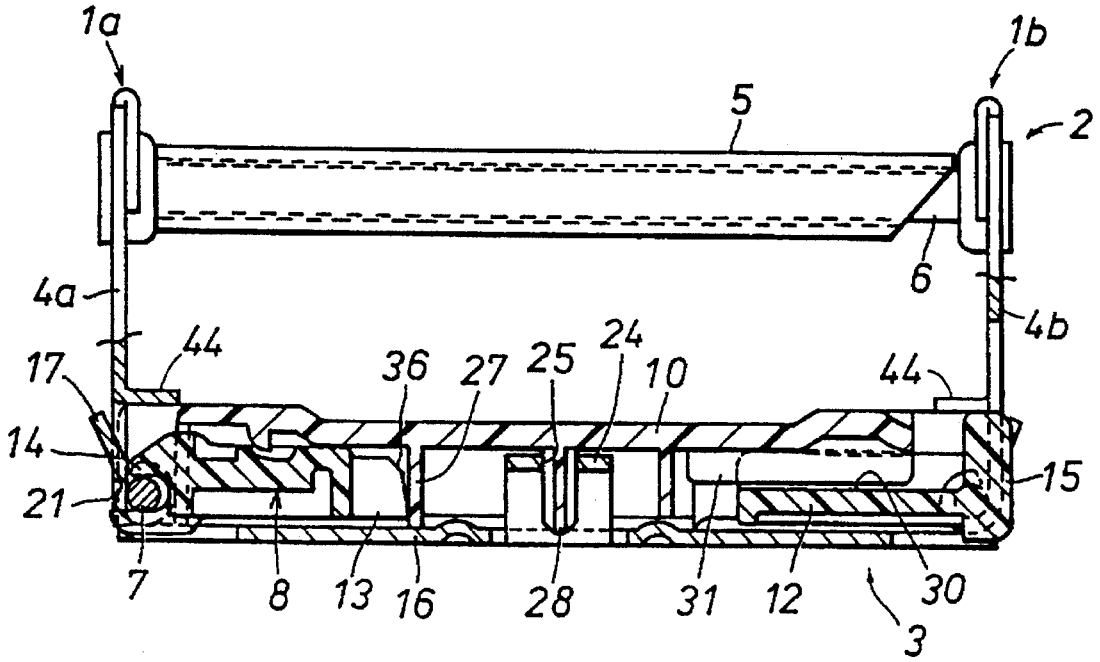
FIG. 3 is a sectional view taken along line III—III of FIG. 2.
Figure 6:
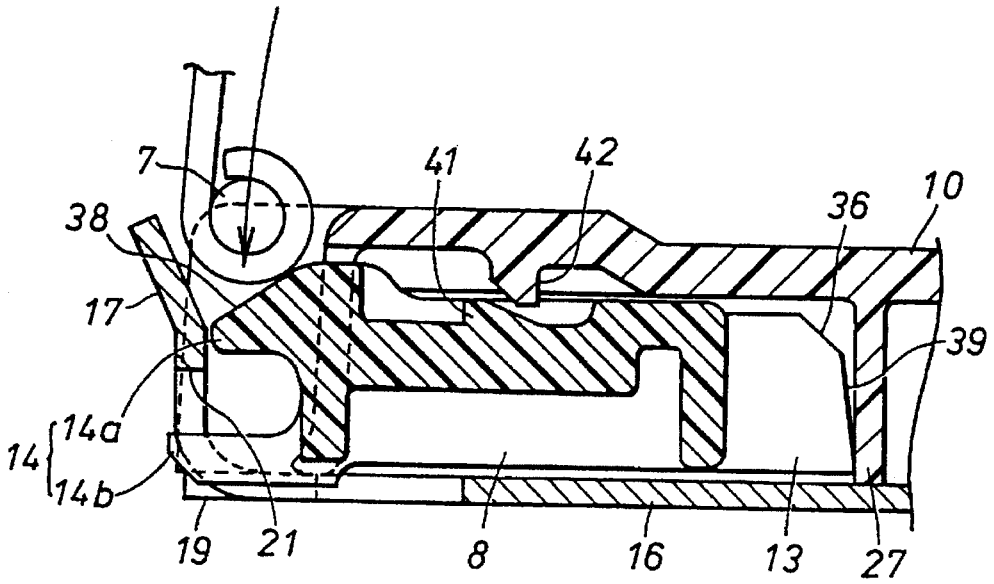
FIG. 6 is an enlarged fragmentary sectional view showing the initial state of the latch member.

Initially, the latch/hinge sections 14 of the latch members 8 project from the side walls of the cover 10 under the spring force of the spring pieces 13 as illustrated in FIG. 6. Therefore, when mounting the clamping unit 2 onto the holder base 3, with the rods 6 of one of the clamping plates 4*b* fitted into the pipes 5 of the other clamping plate 4*a*, the bars 7 are pushed into the latch/hinge sections 14, more particularly, into the unopened gaps between the upper jaws 14*a* of the latch/hinge sections 14 and the latch/hinge tabs 17. Because the upper surfaces of the upper jaws 14*a* are provided with tapered surfaces 38, the downward pressure applied by the bars 7 causes the latch members 8 to be moved inwardly against the spring force of the spring pieces 13, thereby opening a gap, and the bars 7 are ultimately received in the space defined by the upper and lower jaws 14*a* and 14*b* of the latch/hinge sections 14 and the latch/hinge tabs 17 with the latch members 8 returned to the original positions under the spring force of the spring pieces 13 (see FIG. 3). Because the upper pails of the latch/hinge tabs 17 are slightly bent outward and the upper surfaces of the upper jaws 14*a* are provided with the tapered surfaces 38, the bars 7 can be latched by the latch/hinge sections 14 in a reliable fashion even when some dimensional errors are present between the bars 7 and the latch/hinge sections 14.

Figure 7:
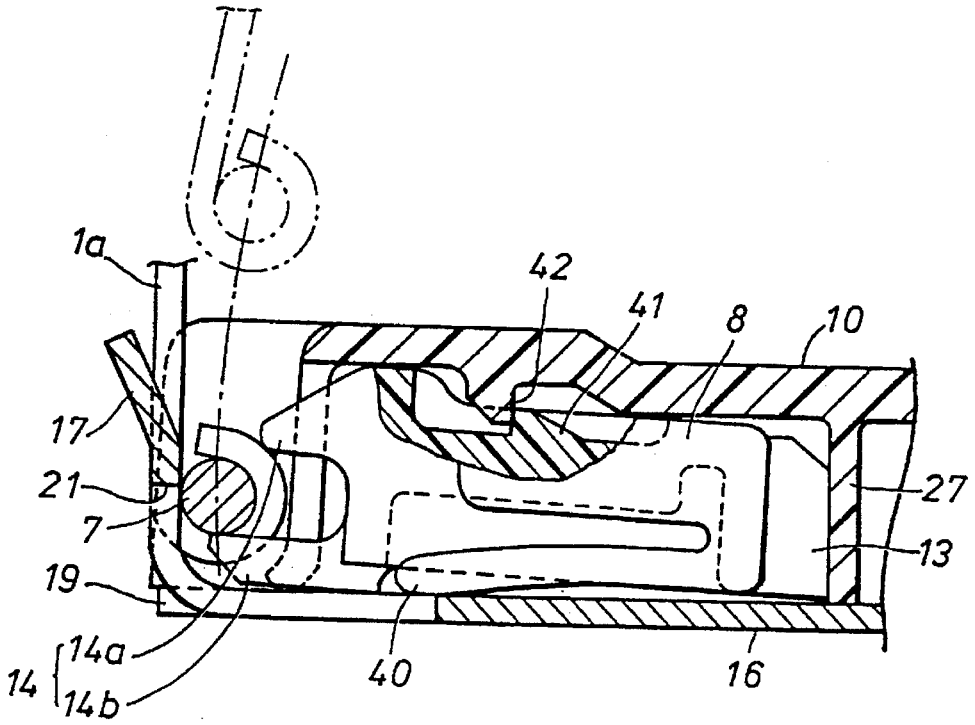
FIG. 7 is an enlarged fragmentary sectional view showing the unlatched state of the latch member.

When the clamping unit 2 is desired to be detached from the holder base 3, for instance to add new sheets of paper to the binder or to remove sheets of paper bound by the binder, the knob 15 of a selected one of the latch members 8 is depressed inward, depending on which end of the binder is desired to be accessed, until a pair of claws 41 provided in the upper end of the latch member 8 pass associated claws 42 provided in the cover 10. This causes the latch member 8 to be displaced inward against the spring force of the spring pieces 13, thereby opening gaps between the upper jaws 14*a* and the latch/hinge tabs 17 to allow the bars 7 to be lifted upward. At the same time, because the free end of each of the spring pieces 13 is provided with an inclined surface 39, a tilting moment is applied to the latch member 8 which tends to raise the jaws 14*a* and 14*b* away from the base plate 9 as illustrated in FIG. 7. The lower end of each of the latch members 8 is provided with a pair of resilient tabs 40 which engage the base plate 16, and normally urge the latch member 8 upward. As a result, when the knob 15 is released, the latch member 8 is urged outward by the spring force of the spring pieces 13, but is retained at the position illustrated in FIG. 7 by virtue of the engagement between the two sets of cooperating claws 41 and 42 with a gap kept defined between the upper jaws 14*a* and the latch/hinge tabs 17 which are wide enough for the bars 7 to pass through.

Therefore, with the latch member 8 engaged in this manner, the bars 7 can be moved out of the space without requiring that the knob 15 be simultaneously depressed. The bars 7 of the other clamping plate 4*a* are kept retained in the space defined by the upper and lower jaws 14*a* and 14*b* of the latch/hinge sections 14 and the corresponding latch/hinge tabs 17. Therefore, the clamping unit 2 can be turned about the bars 7 of the other clamping plate 4*a* so that the clamping unit half 1*a* can be detached from the clamping assembly while the pipes 5 can be pulled away from the rods 6, and the sheets of paper can be removed from the binding assembly.

The other clamping unit half 1*b* can be also detached in a similar fashion. In this case, the bars 7 of the other clamping unit half la serve as the hinge for the clamping unit 2.

Figure 8:
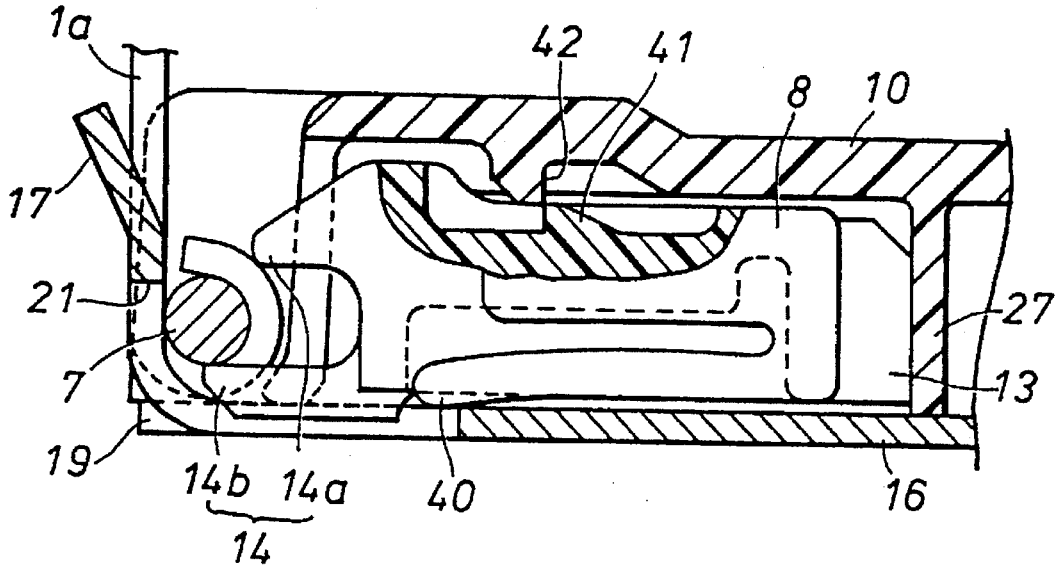
FIG. 8 is an enlarged fragmentary sectional view showing the latch member about to be latched.

When the clamping unit 2 is desired to be attached back to the holder base 3 with the latch member 8 retained in the unlatched condition as described above, the pipes 5 are fitted onto the rods 6, and the bars 7 of the clamping half 1*a* are fitted into the space and pushed against the lower jaws 14*b*. As a result, the latch member 8 is tilted in the direction to disengage the claws 41 from the claws 42, causing the latch member 8 to be moved in the direction to close the gap under the spring force of the spring pieces 13 (see FIG. 8).

Figure 9:
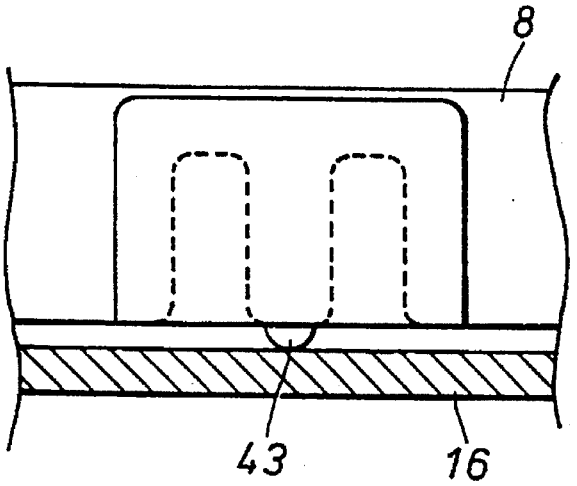
FIG. 9 is an enlarged fragmentary sectional view as seen from arrow IX in FIG. 2 showing the sliding mechanism for the latch member.

The lower surface of each of the latch members 8 is provided with a pair of lateral ridges 43, as illustrated in FIGS. 2 and 9, to ensure smooth movement of the latch member 8. The movement of the latch member 8 is stabilized by the guiding arrangement which involves the cooperation between the guide projection 12 of the latch member 8 and the guide slot 29 of the cover 10, and between the ridge 31 provided in the cover 10 and the groove 30 provided in the upper surface of the latch member 8.

The pressure applied to the clamping unit 2 is supported by the horizontal tabs 19 of the base plate 9 engaging the lower edge portions of the clamping plates 4*a* and 4*b*, in particular the parts crimped around the ends of the bars 7, and the binding assembly is therefore capable of favorably withstanding loads applied from the stack of paper sheets held by the binding assembly. As for the external force which tends to pull the clamping plates 4*a* and 4*b* away from the support base 3, it can be also favorably supported by the binding assembly because the latch members 8 are retained to the base plate 9 by the projections 22 of the latch members 8 engaged by the associated openings 23 provided in the base end of the holding pieces 18, and the inwardly bent upper ends of the holding pieces 18 placed over the latch members 8. The clamping unit 2 is also firmly retained against longitudinal movement by the support base 3, by the side edges 7*i* (where the lower edges of the clamping plates 4*a* and 4*b* are crimped around the end portions of the bars 7) of the cutouts, across which the bars 7 extend, being engaged by the side edges 17*o* of the lower parts of the latch/hinge tabs 17, as illustrated in FIG. 2.

Thus, according to the present invention, the forces applied by the paper stack on the binding assembly are primarily supported by the metallic members while the latching members are relatively free from such loads and can be therefore made of plastic material. To allow the clamping unit to be removed from and latched onto the base support with a single hand, the latching mechanism may be preferably provided with means for keeping the latching mechanism in an unlatched condition. According to the present invention, the means for keeping the latching mechanism in an unlatched condition allows the clamping unit to be removed by using the same hand for unlatching the mechanism and pulling the clamping unit away from the support base, and to be retained by the support base simply by unlatching the mechanism and pushing the clamping unit into the latching mechanism of the support base.

The binding assembly of the present invention is highly simple in structure, and economical and easy to manufacture. By making the essential parts of the latching mechanism with plastic material, it is possible to ensure the accurate and reliable action of the latching mechanism.

Although the present invention has been described in terms of a specific embodiment thereof, it is possible to modify and alter details thereof without departing from the spirit of the present invention. For instance, if the unlatching of the latch members by cooperation of the draws 41 and 42 is not needed, the lower jaws 14*b* of the latch/hinge sections 14, as well as the claws 41 and 42, may be omitted. In this case, the bars 7 may directly abut the base portions of the latch/hinge tabs 17.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A binding assembly for binders, comprising:

a clamping unit including a pair of clamping plates having paper holding means for holding a plurality of sheets of paper therebetween, each clamping plate being provided with a cutout on lower edge thereof, and a bar extending across said cutout;

a holder base including a base plate which is made of a metallic member and adapted to be attached to a binding of a binder; a cover adapted to be fitted over said base plate; and a pair of latch members made of plastic material and received between said base plate and said cover; a latch mechanism being formed between each of said latch members and an associated tab lifted from said base plate for detachably engaging said bar; wherein:

said metallic base plate is provided with first stopper means for supporting a lower edge of each of said clamping plates, second stopper means for engaging a side edge of a cutout formed in the lower edge of each of said clamping plates, and third stopper means for securing each of said latch members from being pulled away from said base plate.

2. The binding assembly for binders according to claim 1, wherein each of said latch members is provided with a knob extending out of a side wall of said cover, spring means urging said latch member outwardly, and an upper jaw which defines a gap in cooperation with said tab for receiving said bar when said latch member is inwardly pressed by said knob against a spring force of said spring means, said gap being closed when said latch member is restored to an initial position thereof under the spring force of said spring means.

3. The binding assembly for binders according to claim 2, wherein an upper surface of said upper jaw is provided with a tapered surface for allowing said upper jaw to be moved away from said associated tab to open said gap when said bar is pressed onto said tapered surface.

4. The binding assembly for binders according to claim 1, wherein a spring means consists of a pair of spring pieces extending obliquely and inwardly from said latch members, free ends of said spring pieces abutting a longitudinal wall depending from an inner surface of said cover.

5. The binding assembly for binders according to claim 1, wherein each of said latch members and said cover are engaged by a first lateral guide mechanism including a lateral groove and a ridge received in said groove.

6. The binding assembly for binders according to claim 5, wherein each of said latch members and said cover are engaged by a second lateral guide mechanism including a projection and an associated slot having a lateral open end for receiving said projection.

7. The binding assembly for binders according to claim 1, wherein said first stopper means comprises an upper surface of a base end of each of said tabs abutting lower edge portions of an associated one of said clamping plates which are crimped over end portions of the bar.

8. The binding assembly for binders according to claim 1, wherein said second stopper means comprises side edges of a base end of each of said tabs, said side edges engaging associated side edges of said cutout across which said bar extends.

9. The binding assembly for binders according to claim 1, wherein said third stopper means comprises a holding piece which lifted from said base plate, and bent laterally at a free end portion thereof for retaining said latch member between said free end portion and said base plate.

10. The binding assembly for binders according to claim 9, wherein said third stopper means further comprises an opening which is provided in an upright part of said holding piece for receiving a complementary projection formed in said latch member.

11. The binding assembly for binders according to claim 1, wherein each of said latch members is provided with a claw on an upper end thereof which is adapted to be engaged by a corresponding claw provided in an inner surface of said cover so as to keep said gap between said upper jaw and said tab open, tilting means for tilting said latch member so as to engage said claw thereof with said corresponding claw when said latch member is inwardly depressed by pressing said knob inwards, and a lower jaw provided under said upper jaw for disengaging said claw of said latch member from said corresponding claw by being pressed downward by said bar.

12. The binding assembly for binders according to claim 11, wherein said spring means consists of a pair of spring pieces extending obliquely and inwardly from each of said latch members, free ends of said spring pieces abutting a longitudinal wall depending from an inner surface of said cover, and said tilting means comprises a slanted abutting surface defined between the free ends of said spring pieces and said longitudinal wall.

13. The binding assembly for binders according to claim 11, wherein said tilting means comprises a spring piece interposed between a relatively external part of a lower surface of each of said latch members and said base plate.

* * * * *